United States Patent [19]

Barcella

[11] 4,037,822

[45] July 26, 1977

[54] SCISSORS JACK

[75] Inventor: Giovanni Barcella, Zurich, Switzerland

[73] Assignee: AB Nike Hydraulik, Eskilstuna, Sweden

[21] Appl. No.: 572,498

[22] Filed: Apr. 28, 1975

[30] Foreign Application Priority Data

May 6, 1974 Sweden ..... 7406043

[51] Int. Cl.[2] ..... B66F 3/24

[52] U.S. Cl. ..... 254/124

[58] Field of Search ..... 254/93 R, 124, 126

[56] References Cited

U.S. PATENT DOCUMENTS

| | | | |
|---|---|---|---|
| 1,638,859 | 8/1927 | Knowles | 254/126 |
| 3,292,903 | 12/1966 | Meyer et al. | 254/124 |
| 3,635,440 | 1/1972 | Gompel | 254/124 |

*Primary Examiner*—Al Lawrence Smith
*Assistant Examiner*—Robert C. Watson
*Attorney, Agent, or Firm*—Pollock, VandeSande & Priddy

[57] ABSTRACT

A scissors jack for raising motor vehicles and the like comprises two pairs of links forming an angle with each other in substantially a common plane and pivotally connected with each other at their free ends. The links in each pair are also pivotally connected with each other on a pivot axis, and an actuating fluid power cylinder is mounted between said pair of pivot axes of the pairs of links for varying the distance therebetween. The improvement consists therein that the two pairs of links are turned in the same direction and that the fluid power cylinder is located in its entirety between said pairs of links and adapted to spread apart said pivot axes when raising.

3 Claims, 2 Drawing Figures

SCISSORS JACK

Figure 1:
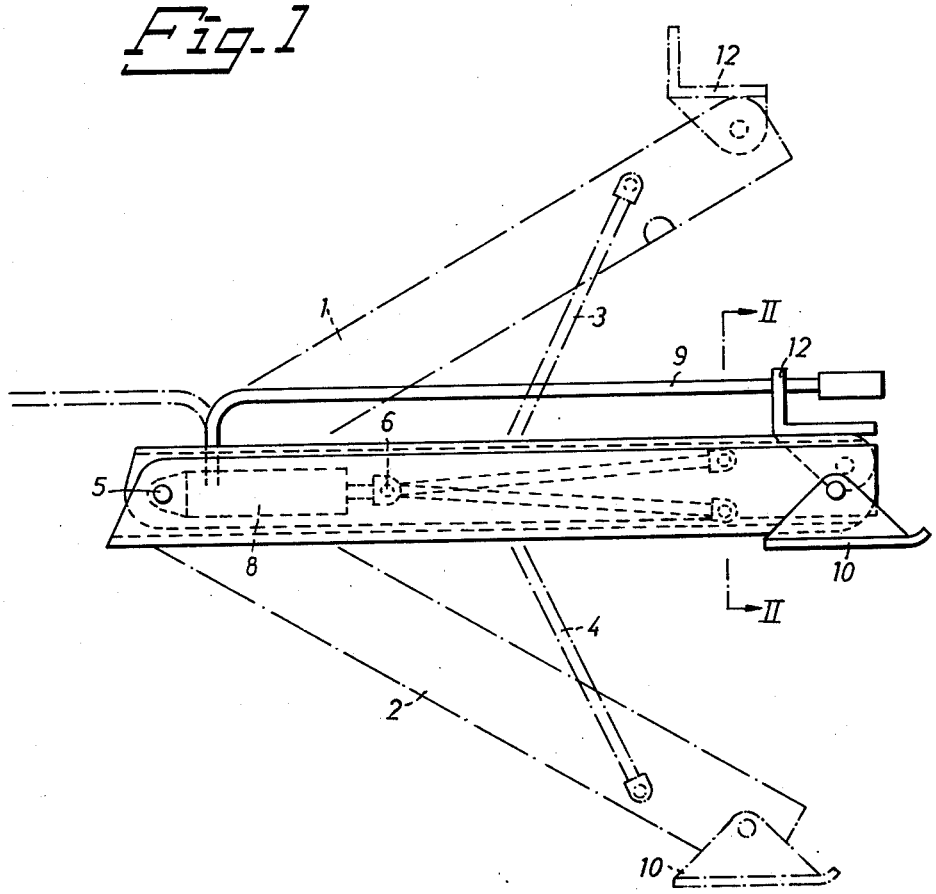

The present invention refers to a scissors jack for raising motor vehicles and the like and comprising two pairs of links forming an angle with each other in substantially a common plane and pivotally connected with each other at their free ends, the links in each pair also being pivotally connected with each other on a pivot axis, and an actuating fluid power cylinder mounted between said pair of pivot axes of the pairs of links for varying the distance therebetween.

Jacks and particularly those adapted for raising of motor vehicles are in principle substantially of two different kinds, namely mechanical or hydraulic. The mechanical jacks operate almost solely with some kind of screw motion, either in that a nut member moving along a vertical threaded rod acts directly on the object to be raised, or a bolt and nut mechanism is brought to vary the distance between two opposite pivot points in a scissors link mechanism, namely in a so-called scissors jack. On the other hand, hydraulic jacks comprise a cylinder with a raising piston movably mounted therein and actuated by a pressure fluid and a pump cylinder with a pump piston mounted therein for providing the required operative pressure of the pressure fluid.

Originally mechanical jacks were completely dominating as the automotive vehicle accessory used to change a wheel when running flat or the like, due primarily to the fact that said mechanical jacks have been relatively substantially must less expensive to manufacture than hydraulic jacks. Even though the costs of manufacturing mechanical jacks have been reduced even further in recent years due to mass production techniques, the manufacturing costs for hydraulic jacks have been enormously reduced in the latter years, particularly in large scale production, and such hydraulic jacks have simultaneously become more reliable. Therefore, hydraulic jacks have begun to be a more and more serious competitor to mechanical jacks as far as price is concerned and thus the drawbacks of the mechanical jacks have become more and more important.

The mechanical jacks operating with some kind of screw motion all have the common disadvantage that the screw motion is heavy and severe to carry out when the raising motion is comparatively large per time unit, and the ratio selected must therefore be relatively small. The raising of a car by means of a mechanical jack by screwing up the same is therefore ordinarly a very laborious task. Although mechanical jacks primarily are intended to raise only one side of a vehicle or even one end of the side of a vehicle, the jack mostly acts on single point on the vehicle body, which implies that the raising height, i.e. the screwing work, becomes very great since the actual wheel suspensions first must be completely relieved before the wheels leave their contact with the ground and the desired wheel change or the like can be made. Particularly when such mechanical jacks are to be incorporated as a standard equipment in a motor vehicle, substantial requirements are put on the jack not to be too great and cumbersome or too expensive in manufacture. This has led to mechanical jack structures which in practice often have turned out also to be instable in use such that they both become dangerous to the person using the jack and can give raise to hazards for damages on the vehicle when they overturn or are dislocated in other respects. For avoiding such overturning it has been considered necessary in many motor vehicles to include particular jack attachments in which an operative portion of the jack thus is to be introduced and to be secured by shape, but in its turn this leads to reduced utility for various jacks for various vehicles.

Much easier than the mechanical jacks the hydraulic jacks can be given such a dimensioned ratio between the pump motion and the raising motion that the user feels a greater convenience when using the hydraulic jack. Primarily this is achieved by a suitable adaptation of the length of the pump lever relative to the pump piston area and stroke and the raising piston area and stroke.

An extremely cheap and thus advantageous kind of mechanical jack as seen from a manufacturer's point of view is the above-mentioned scissors jack, but it has not been possible to replace the bolt and nut mechanism used therein by some kind of hydraulic mechanism since said mechanism in all embodiments hitherto known operate to effect a drawing motion which is unsuitable for a hydraulic piston and cylinder mechanism.

Van Gompel U.S. Pat. No. 3,635,440 issued Jan. 18, 1972, for "Force-Exerting Apparatus" discloses a scissors jack (or better, an expander mechanism); which is fluid power cylinder operated with the cylinder working with a thrust force on said mechanism. Said mechanism is primarily adapted for use in straightening deformed rolls of sheet stock, and for this purpose it is beneficial if the scissors-link mechanism can be collapsed as much as possible. Moreover, it is only advantageous when the power cylinder extends laterally almost entirely beyond said link mechanism for facilitating the introduction of the overall mechanism into a roll to be straightened. On the contrary for automotive use such a laterally extending cylinder is extremely bulky and obstructive, particularly when the jack is to be used as a standard equipment in modern passenger cars. For a vehicle jack the mechanism need not be collapsible beyond an extent corresponding to the diameter of the fluid cylinder.

The main object of the present invention is to provide a mechanical jack operated by a fluid power cylinder as above-stated but lacking the stated drawbacks. The invention is based on the idea that by a suitable redesign of prior scissors jacks they are much better adapted for modern automotive uses.

The above-stated object is achieved in a scissors jack of the kind stated, by a positioning of the two pairs of links so that they are turned in the same direction with one of the pairs being situated inside the other, and by locating the fluid power cylinder in its entirety between the pair of pivot axes of said pairs of links with the cylinder being adapted to spread apart said pivot axes when the jack is raised.

Owing to the invention a structurally simple hydraulic jack is provided which is inexpensive from a manufacturing point of view and simultaneously has the advantages of a hydraulic jack, but in which the drawbacks of the mechanical jack are eliminated as far as laborious operation and poor stability is concerned.

Figure 2:
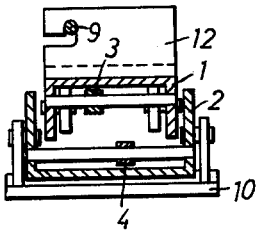

By way of example a preferred embodiment of the invention will now be described with reference to the accompanying drawings in which FIG. 1 is a side elevational view of a scissors jack according to the invention in collapsed condition and with the almost completely raised or expanded state of the jack being illustrated with broken lines, and FIG. 2 is an end elevational view partly in section of the scissors jack according to the invention.

As illustrated in the drawings the scissors jack according to the present invention comprises two pairs of links 1, 2 and 3, 4, respectively, located substantially in one and the same plane. The two links in each pair are mutually connected at one end at pivot points 5 and 6, respectively, and at their opposite free ends the links of each pair are pivotally connected with the respective link of the other pair. In order to change this scissors link mechanism known in principle so as to be actuated between its pivot points 5, 6 with a thrust or pressure force instead of a tension and thus make the jack suited for operation by means of an hydraulic pressure cylinder the second link pair 3, 4 is mounted according to the invention so that it is oriented in the same direction as the first link pair 1, 2 i.e the second link pair 3, 4 is situtated inside the first link pair 1, 2. For increasing the angle between the links 1 and 2 of the first link pair and thus for carrying out a raising operation by means of the jack, the pivot points 5 and 6 of the two link pairs must be spread apart and this can advantageously be obtained by an hydraulic pressure cylinder 8, of a kind usually used in this connection. In the embodiment illustrated in the drawings the housing of the pressure cylinder 8 in this case is connected with the pivot point 5 of the first link pair 1, 2 while the free end of the piston rod of said cylinder 8, is connected with the pivot point 6 of the second link pair 3, 4. A pump cylinder generally known and therefore not further disclosed in the drawings is actuated by a pump lever 9, for providing a desired operating pressure in the cylinder 8. There is of course also on the cylinder 8 a pressure relief valve not further illustrated and adapted for returning the pressure cylinder and collapsing of the jack, i.e. a lowering of the raised motor vehicle or the like.

From the view-point of using the jack, the above-described basic structure of the scissors jack can be advantageously realized in practice in a very attractive way. Thus the two outer links 1, 2 can be made as channel members of pressed sheet metal with relatively great width which fit into each other, so that they in the collapsed position completely enclose and protect the inner link pair 3, 4 and the hydraulic cylinder 8 with its actuating mechanism. Although the inner link pair 3, 4 in the drawings has been disclosed as made of rods or tubes, it is of course also possible to manufacture even these links as channel pressings, however with a maximum width somewhat less than the internal width of the inner link of the first pair.

For obtaining a rigid support on the base or ground one link of the first pair is provided at its free end with a pivotally mounted foot member 10, while the free end of the other link of the first pair adapted for engagement with the motor vehicle or object to be raised, is provided with a support plate 12 also pivotally mounted and having a suitable cross-sectional shape, such as the angular shape illustrated in the drawings. Then there is a posibility to let the pump lever 9 in rest position in the collapsed condition of the jack engage a notch in the upwardly-directed flange of the support plate 12 so as to form a suitable handle for carrying the jack.

Although the present invention is particularly suited for use as a standard equipment in modern passenger cars it can also be modified and provided with wheels or rollers on the lower outer link for being used as a service jack.

Owing to the above-described embodiment according to the invention it is now possible to provide a scissors jack which is inexpensive to manufacture mostly due to the use of simple mechanical parts in the form of sheet pressings with an hydraulic pressure cylinder consisting of a well-known commonly used jack cylinder with very small alterations.

The jack according to the present invention also has the other advantages of a mechanical scissors jack but not the drawbacks thereof, which instead have been substituted by the advantages of the hydraulic actuation mechanism.

I claim:

1. A scissors jack for lifting motor vehicles and the like, comprising a pair of first elongated substantially coextensive links disposed in a common plane, corresponding first ends of said pair of first links being pivotally connected to one another at a first pivot point whereby the other ends of said first links may be disposed closely adjacent to one another and may be selectively displaced relative to one another in said plane about said first pivot point, first engaging means adjacent the other end of one of said first links adapted to engage a ground surface, second engaging means adjacent the other end of the other of said first links adapted to engage a vehicle to be lifted, each of said first links being channel-shaped in cross section with said channel shapes being disposed in opposing relation to one another whereby, when said other ends of said first links are disposed closely adjacent to one another, said channel-shaped first links define an elongated cavity therebetween extending from said first pivot point to said other ends of said first links, a pair of elongated second links diposed in said common plane between said first links, one end of each of said second links being pivotally and inseparably connected to said first links respectively at predetermined fixed locations adjacent said other ends of said first links, the other ends of said second links being pivotally connected to one another at a second pivot point located in said common plane, said second links being shorter in length than said first links and extending from said other ends of said first links toward said first pivot point whereby said second pivot point is located in said elongated cavity at a position between said first pivot point and the pivotally interconnected ends of said first and second links, a hydraulic cylinder located entirely within said elongated cavity between said first and second pivot points, said channel-shaped first links having differing widths whereby one of said channel-shaped first links nests within the other of said channel-shaped first links when said other ends of said first links are in close proximity to one another to completely enclose and protect said second links and said hydraulic cylinder, and control means for applying fluid pressure to said cylinder to urge said second pivot point away from said first pivot point thereby to cause said second links to move the other ends of said first links and the engaging means thereon away from one another, said control means including means for selectively relieving said applied fluid pressure to cause said other ends of said first links to move toward and into close proximity to one another in response to enternal forces applied between said first and second engaging means, and said control means further including an elongated, manually operable lever disposed closely adjacent to and substantially coextensive with one of said elongated first links.

2. The jack of claim 1 wherein each of said second links comprises an elongated rod.

3. The jack of claim 1 wherein each of said second links is channel-shaped in cross section, the widths of said channel-shaped second links being less than the widths of said channel-shaped first links.

* * * * *